US007841827B2

(12) United States Patent
Keener

(10) Patent No.: US 7,841,827 B2
(45) Date of Patent: Nov. 30, 2010

(54) BLADE SET FOR MASSERATING EFFLUENT WATER IN A SEWAGE PUMP

(76) Inventor: Robert M. Keener, 1186 State Rte. 511 North, Ashland, OH (US) 44805

( * ) Notice: Subject to any disclaimer, the term of this patent is extended or adjusted under 35 U.S.C. 154(b) by 723 days.

(21) Appl. No.: 11/865,758

(22) Filed: Oct. 2, 2007

(65) Prior Publication Data

US 2009/0087317 A1 Apr. 2, 2009

(51) Int. Cl.
*F03B 3/12* (2006.01)

(52) U.S. Cl. ..... 415/121.1; 416/224

(58) Field of Classification Search ..... 415/121.1; 416/198 R, 224
See application file for complete search history.

(56) References Cited

U.S. PATENT DOCUMENTS 3,885,745 A * 5/1975 Hankes et al. ..... 241/46.11
4,011,027 A * 3/1977 Selder ..... 415/121.3
4,238,079 A * 12/1980 Otto ..... 241/248
4,778,336 A * 10/1988 Husain ..... 415/121.1
4,911,368 A * 3/1990 Nishimori ..... 241/46.017
5,016,825 A * 5/1991 Carpenter ..... 241/46.06

* cited by examiner

*Primary Examiner*—Igor Kershteyn
(74) *Attorney, Agent, or Firm*—Alan Kamrath; Kamrath & Associates PA

(57) ABSTRACT

A blade set for masserating effluent solids in a sewage pump is composed of a cutter ring and a wheel blade adapted to attach to an effluent water inlet at the lower base. Particularly, the cutter ring has an inner wall and multiple recesses defined on the inner wall to accept enhancing blocks made of tungsten carbide. Correspondingly, the wheel blade has multiple blade strips and each blade strip has a cutout defined at edge to combine with an enhancing corner also made of tungsten carbide. By having the structure made of tungsten carbide, the cutter ring and the wheel blade has excellent wearing resistance and less abrasion loss to keep the operational efficiency to masserate the effluent solids and to extend the lifespan of the sewage pump.

2 Claims, 6 Drawing Sheets

BLADE SET FOR MASSERATING EFFLUENT WATER IN A SEWAGE PUMP

BACKGROUND OF THE INVENTION

1. Field of the Invention

The present invention relates to a blade set, and more particularly to a blade set composed of a cutter ring and a wheel blade that both have multiple enhancing pieces made of tungsten carbide so that the sewage pump is prevented from wearing damage to keep excellent masserating function and to improve lifespan.

2. Description of Related Art

Conventional structure of sewage pumps as shown in FIGS. 1 and 2 each substantially has a central shaft 1 of a motor sleeved with an impeller disk 2 and a wheel blade 3 that are driven to rotate by the driving of motor. The impeller disk 2 has multiple impeller vanes arranged in radially and vertically on its lower surface and is accommodated inside an impeller chamber 5 of a lower base 4. The wheel blade 3 has multiple blade strips in a certain number and is mounted in an effluent water inlet 6 below the impeller chamber 5. Moreover, a cutter ring 7 is attached on an inner wall of the effluent water inlet 6. An effluent water outlet 8 is defined at one side of the impeller chamber 5 to connect with drain pipe (not shown). By having the above-described structure, the central shaft 1 drives the impeller disk 2 and the wheel blade 3 to rotate and to the effluent water via the effluent water inlet 6 below the impeller chamber 5 when the motor of sewage pump operates. Meanwhile, the wheel blade 3 cooperates with the cutter ring 7 to masserate and scatter the solids in the effluent water and then the impeller vanes on the impeller disk 2 push the effluent water to the effluent water outlet 8 to drain out via the drain pipe. Therefore, the effluent solids on a bottom of the sewage tank can be eliminated.

With particular reference to FIG. 2, the cutter ring 7 and the wheel 8 blade 3 of the conventional sewage pump are disclosed. The cutter ring 7 has an inner wall and multiple sharp protrusions 701 formed on the inner wall. Correspondingly, the wheel blade 3 has multiple sharp portions 301 individually defined on the multiple blade strips and slightly contact with some of the multiple sharp protrusions 701 on the cutter ring 7 to perform cutting when the wheel blade 3 rotates. When the effluent water is drawn to the effluent water inlet 6 at the bottom of the lower base 4, the sharp portions 301 on the wheel blade 3 cooperate with the sharp protrusions 701 of the cutter ring 7 to perform the rotation cutting and to efficiently masserate the effluent solids.

Although the sharp protrusions 701 of the cutter ring 7 and the sharp portions 301 of the wheel blade 3 are all made of steel, abrasive solids in the sewage pump cause damages surfaces of the sharp protrusions 701 and the sharp portions 301. Additionally, the surfaces of the sharp protrusions 701 and the sharp portions 301 of the wheel blade 3 must have close proximity with each other during rotation, abrasive solids in the effluent shorten the lifespan of both sharp portions 701, 301 made of Cu material. Moreover, the masserating efficiency can not be maintained to prevent the coagulation of the effluent water and some large suspended solids pieces to clog the impeller disk 2. Therefore, the large pieces of the effluent solids get stuck to the impeller vanes of the impeller disk 2. Thus, the effluent water can not be drained out smoothly and the operation of the impeller disk 2 is interrupted. In these cases, the masserating efficiency is reduced and malfunction rate is increased.

SUMMARY OF THE INVENTION

A main objective of the present invention is to provide a blade set that comprises multiple enhancing pieces made of tungsten carbide to sufficiently reduce the abrasion problem caused by rotation cutting to keep efficiently masserating effluent solids when sewage pump operates.

Another main objective of the present invention is to provide a blade set that comprises multiple enhancing pieces made of tungsten carbide so that the operational efficiency can be maintained and thus the malfunction possibility is reduced.

To achieve the foregoing main objectives of the blade set in the present invention, the blade set comprises:

a wheel blade adapted to be driven by a motor and having multiple blade strips formed on the wheel blade, wherein each of the multiple blade strip has an outermost edge, a cutout defined at the outermost edge, and an enhancing corner made of a wear-resisting rigid material and engaged with the cutout; and a cutter ring sleeving around the wheel blade and having an inner wall, multiple grooves and multiple recesses alternatively and longitudinally defined on the inner wall, wherein each of the multiple recess engages with an enhancing block made of a wear-resisting rigid material and slightly contacting with enhancing corners when the wheel blade rotates.

By making functioning parts of the blade set of wear-resisting rigid material durability of the blade set is improved to keep the sewage pump operating efficiently.

Further benefits and advantages of the present invention will become apparent after a careful reading of the detailed description with appropriate reference to the accompanying drawings.

BRIEF DESCRIPTION OF THE DRAWINGS

8

DETAILED DESCRIPTION OF THE PREFERRED EMBODIMENT

Figure 1:
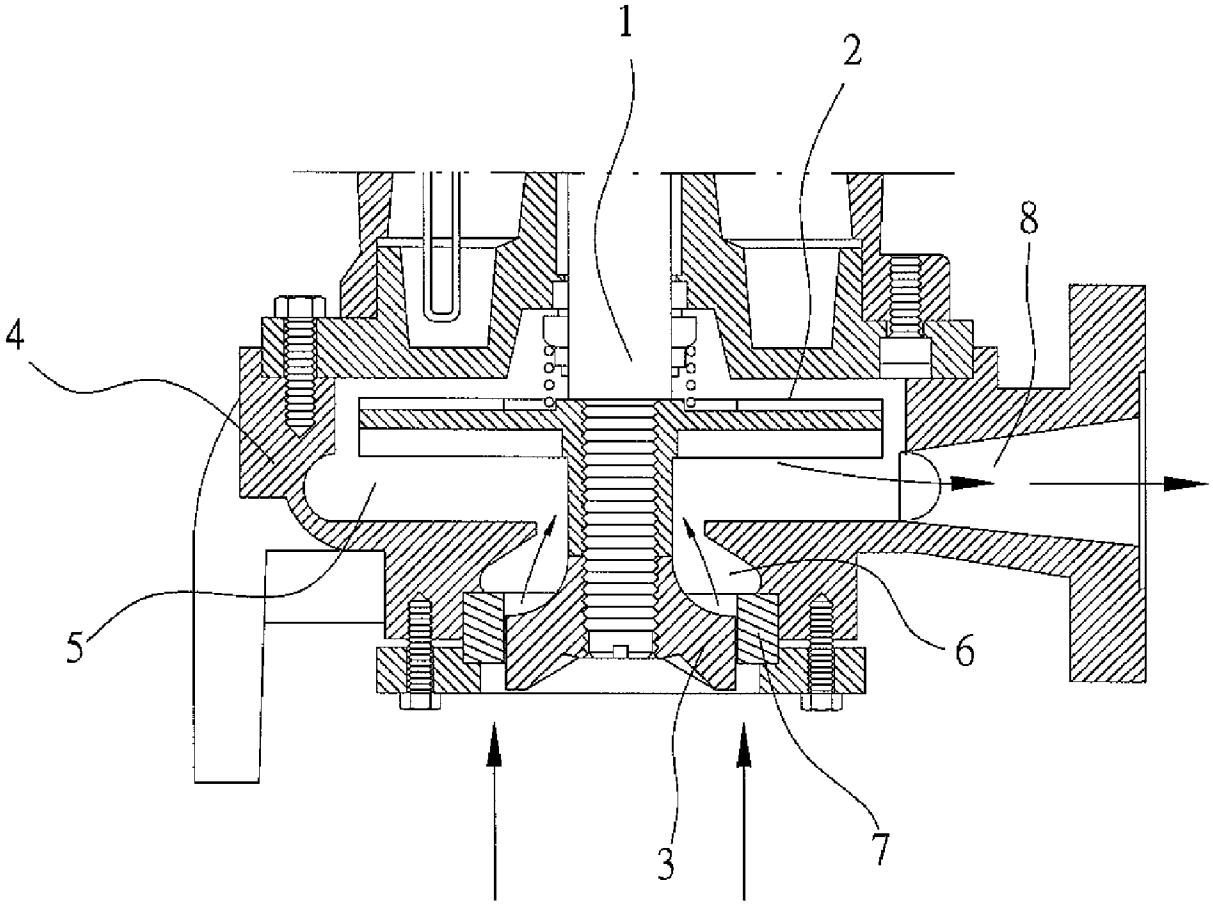
FIG. 1 PRIOR ART
FIG. 1 is a partially cross-sectional side view of a conventional sewage grinder pump with a blade set in accordance with the prior art.
Figure 2:
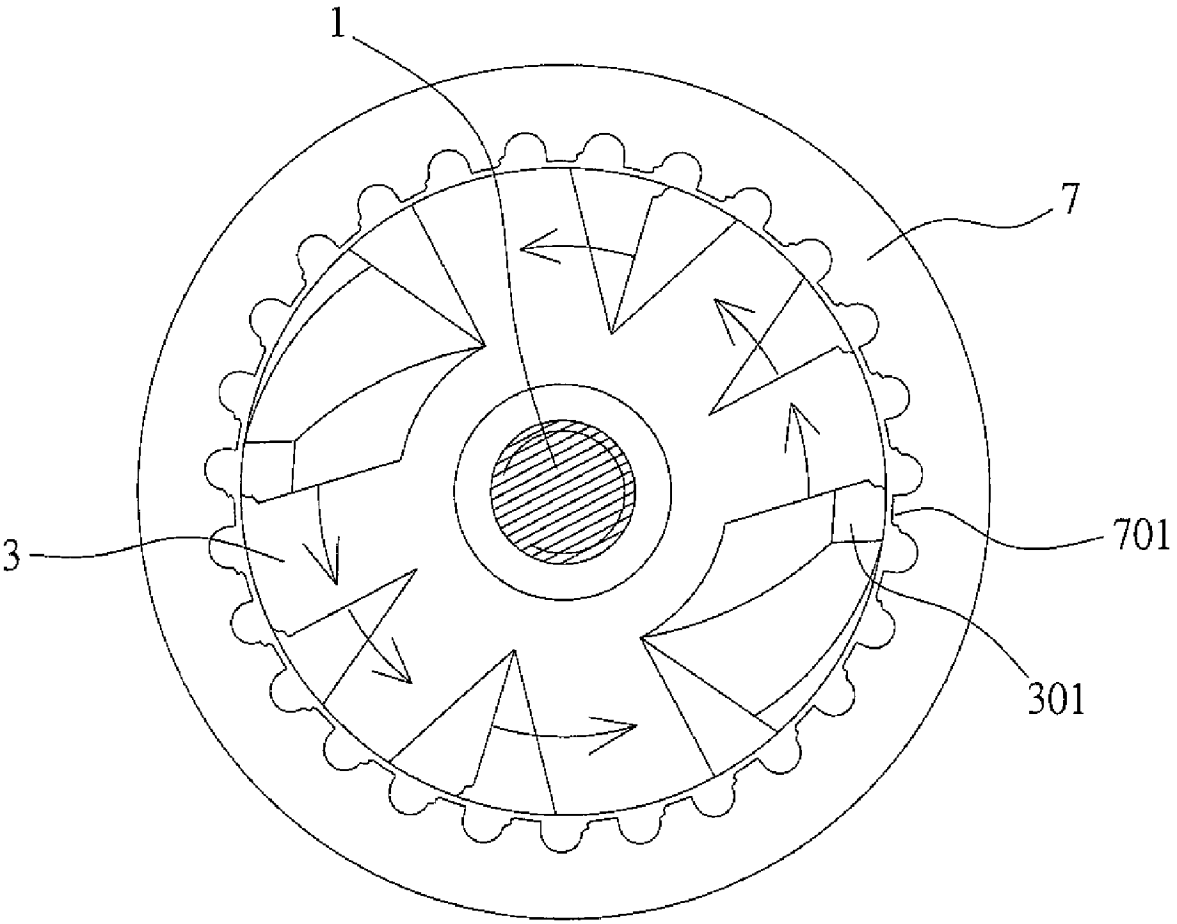
FIG. 2 PRIOR ART
FIG. 2 is a partially cross-sectional top view of the blade set of conventional sewage pump as shown in FIG. 1.
Figure 4:
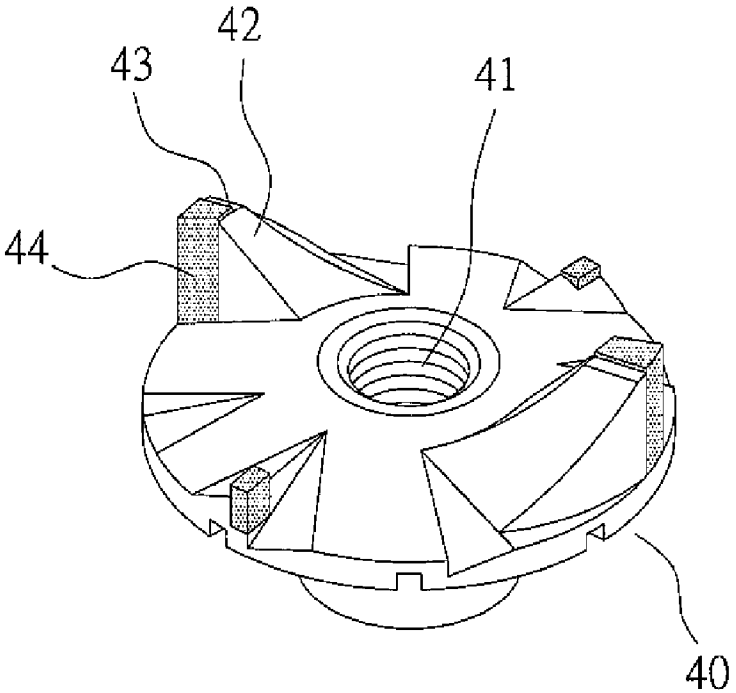
FIG. 4 is a perspective view of the wheel blade of the blade set in FIG. 3, wherein the wheel blade is assembled.
Figure 3:
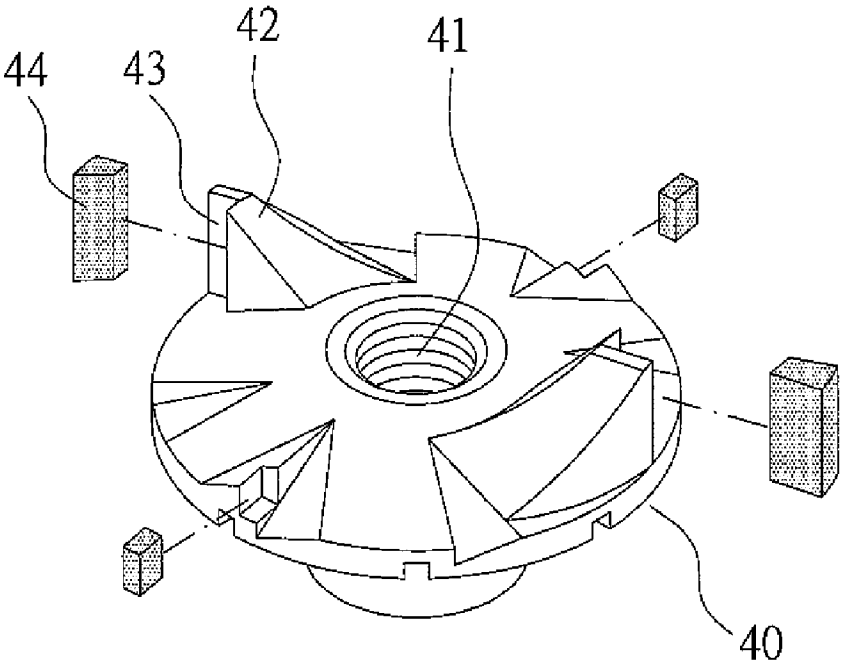
FIG. 3 is an exploded perspective view of a wheel blade of a blade set in accordance with the present invention.
Figure 6:
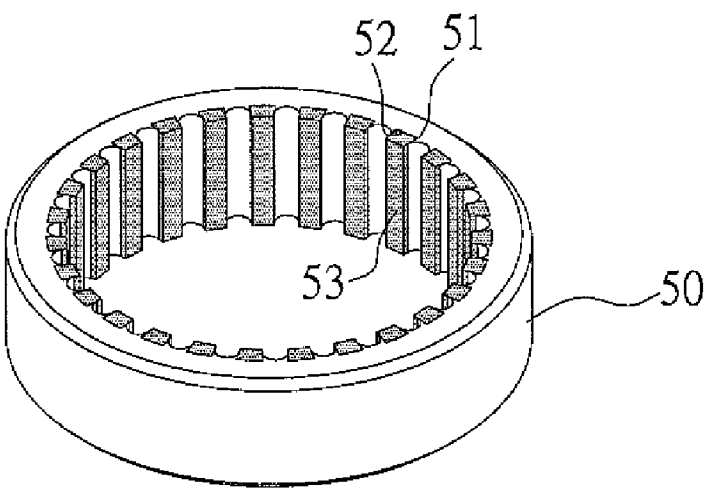
FIG. 6 is a perspective view of the cutter ring of the blade set in FIG. 5, wherein the cutter ring is assembled.
Figure 5:
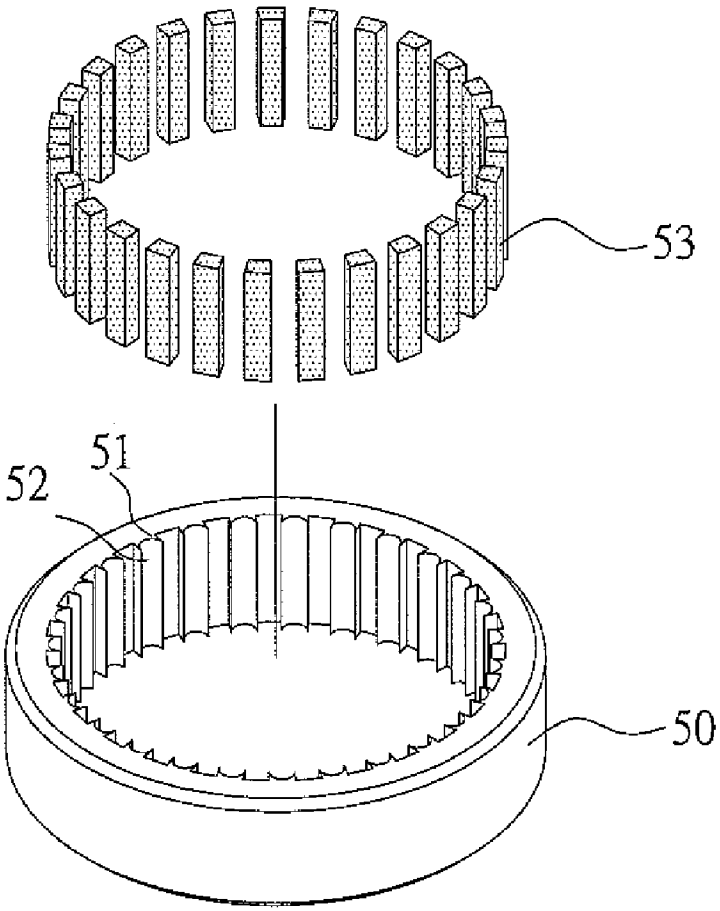
FIG. 5 is an exploded perspective view of a cutter ring of a blade set in accordance with the present invention.
Figure 8:
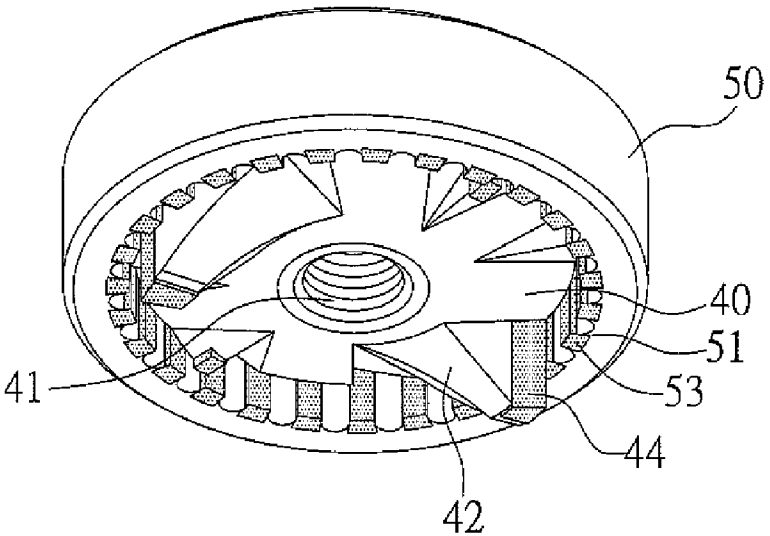
FIG. 8 is a perspective view of the blade set in FIG. 7, wherein the blade set is assembled.
Figure 7:
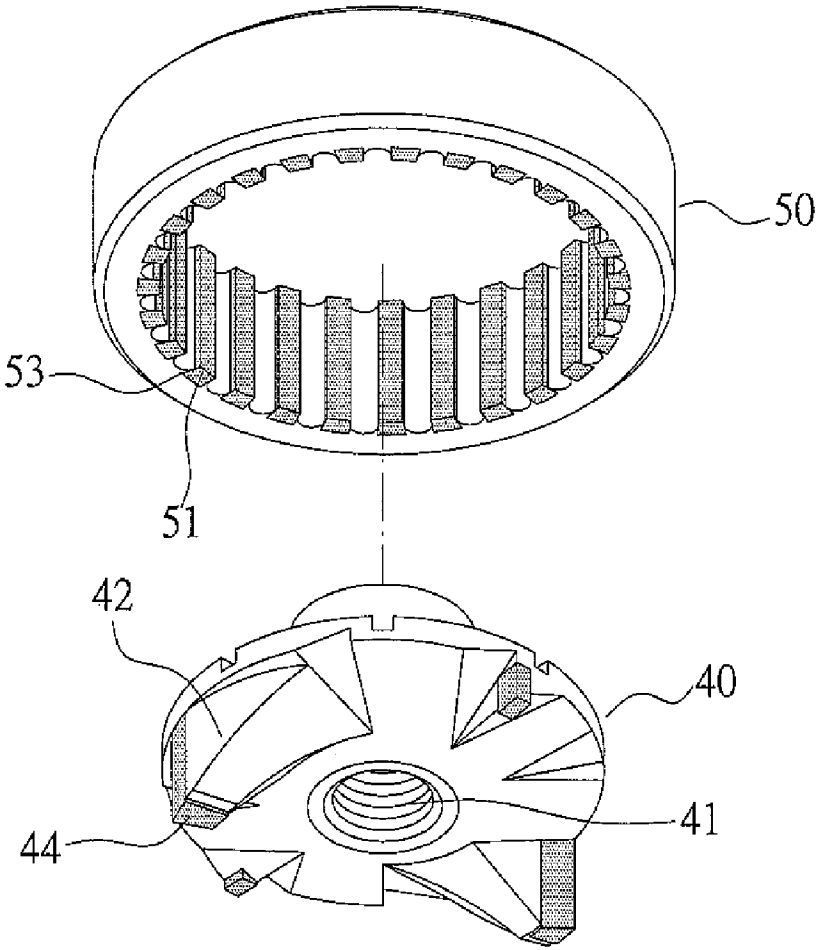
FIG. 7 is an exploded perspective view of the blade set in accordance with the present invention.

A blade set for masserating effluent water in a sewage grinder pump in accordance with the present invention comprises a cutter ring and a wheel blade adapted to attach to an effluent water inlet at the lower base. Particularly, the cutter ring has an inner wall and multiple recesses defined on the inner wall to accept enhancing blocks made of tungsten carbide. Correspondingly, the wheel blade has multiple blade strips and each blade strip has a cutout defined at edge to combine with an enhancing corner also made of tungsten carbide. By having the structure made of tungsten carbide, the cutter ring and the wheel blade has excellent wearing resistance and less abrasion loss to keep the operational efficiency to masserate the effluent solids and to extend the lifespan of the sewage pump.

With reference to FIGS. 3 to 10, the blade set in the present invention adapted to mount in a sewage pump that substantially comprises a pump 10, a lower base 20 with an impeller chamber 21 mounted to a bottom of the pump 10, an impeller disk 30 received inside the impeller chamber 21, and the blade set mounted below the impeller disk 30, wherein the blade set in the present invention is composed of a cutter ring 50 and the wheel blade 40.

Figure 9:
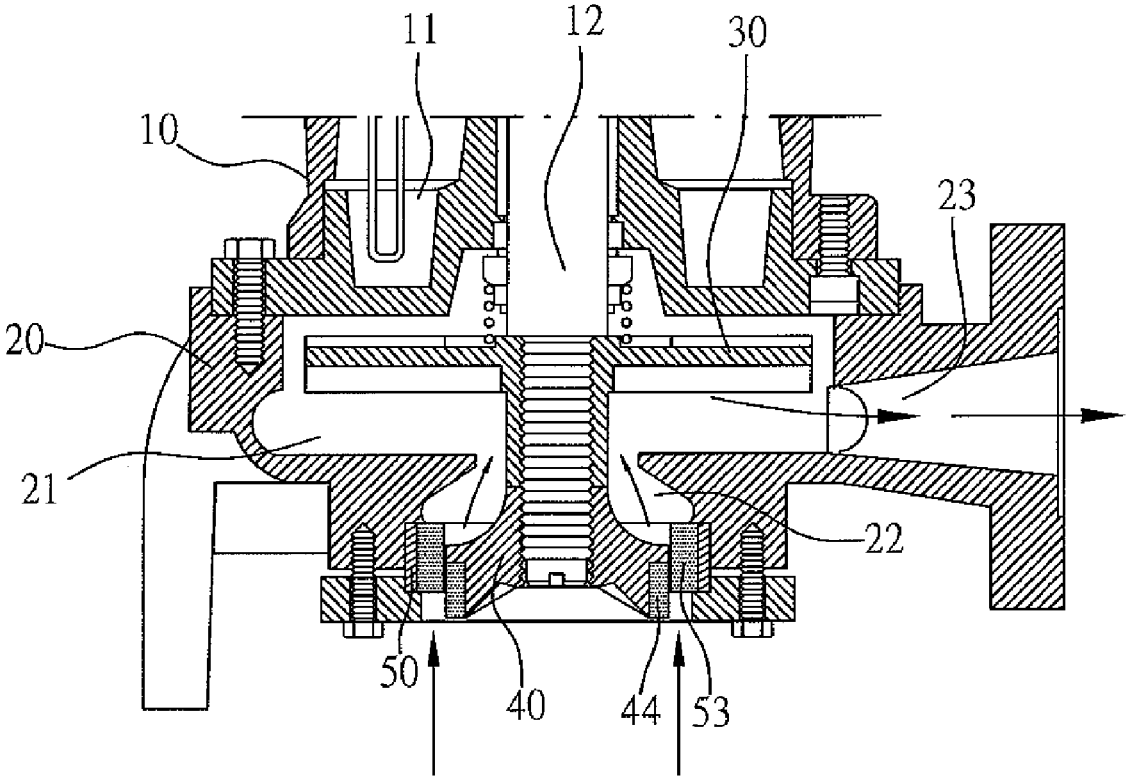
FIG. 9 is a cross-sectional side view of the blade set combined with other elements in a sewage pump.
Figure 10:
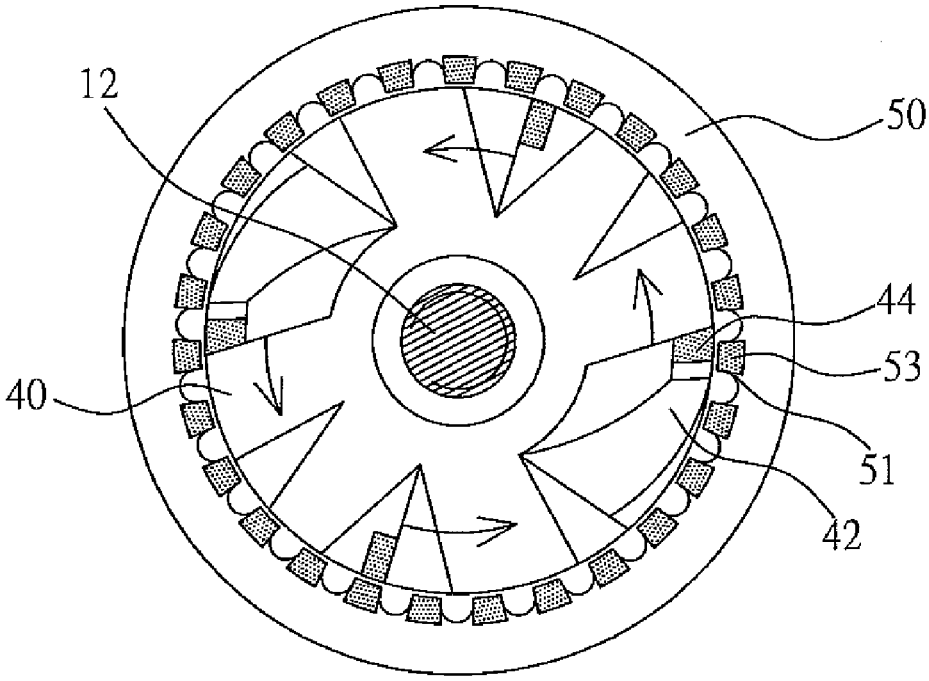
FIG. 10 is cross-sectional top view of the blade set with other elements as shown in FIG. 9.

The pump 10 has a motor 11 with a central shaft 12 penetrating the impeller disk 30 and the wheel blade 40. The pump 10 is mounted on the lower base 20 by screws. The lower base 20 is hollow to perform the impeller chamber 21 and has a lower port with an effluent water inlet 22. The cutter ring 50 is attached to an inner periphery of the effluent water inlet 22 and is centered and aligns with the wheel blade 40 in horizontal. The wheel blade 40 is coaxially mounted with the impeller disk 30 so that the motor 11 enables to drive the impeller disk 30 and the wheel blade 40 synchronously. Moreover, an effluent water outlet 23 is defined at a sidewall of the lower base 20 to communicate with the impeller chamber 21 and mounted with a drain pipe (not numbered, as shown in FIG. 9). By having the arrangement described above, when the motor 11 of the pump 10 actuates, the impeller disk 30 and the wheel blade 40 are driven synchronously to generate a current suction force to draw the effluent water in sewage tank (not shown) into the impeller chamber 21 via the effluent water inlet 22. Meanwhile, the effluent solids is masserated by the operation of the wheel blade 40 with the cutter ring 50 and then masserated effluent solids are drained out via the effluent water outlet 23 and the drain pipe. Thereby, the effluent solids in the sewage tank are eliminated.

Wherein, the blade set mounted in the effluent water inlet 22 is further modified to improve the wearing resistance and masserating efficiency. The wheel blade 40 has an shaft hole 41 defined at its center to engage with the central shaft 12 of the motor 11 and has multiple blade strips 42 in a certain number formed on a bottom face at edge. Each blade strip 42 has a cutout 43 defined at an outermost edge to receive an enhancing corner 44 made of high hardness material such as tungsten carbide and having a sharp edge facing the cutter ring 50. Correspondingly, the cutter ring 50 has an inner wall and multiple grooves and recesses 52 alternatively and longitudinally defined on the inner wall in parallel. Each recess 52 receives an enhancing blocks 53 made of high hardness such as tungsten carbide to perform a cutting portion 51. Each enhancing blocks 53 extends out of the recess 52 and has two sharp side-edges slightly contacting with the sharp edge of the wheel blade 40. Combination between the enhancing blocks 53 and the corresponding recess 52 on the cutter ring 50 is selectively by soldering, wedging, gluing or other well-known technology in present.

By composing the foregoing described structure, the central shaft 12 of the motor 11 drives the impeller disk 30 and the wheel blade 40 coaxially mounted thereon to rotate synchronously to generate current suction efficiency and to draw effluent water at bottom of the sewage tank into the lower base 20 via the effluent water inlet 22 when the motor 11 of the pump 10 actuates. The wheel blade 40 and the cutter ring 50 within the effluent water inlet 22 perform a rotation cutting to masserating the effluent solids. Then, the masserated effluent solids with the sewage is driven by rotation of the impeller vanes 31 on the impeller disk 30 and drained out via the effluent water outlet 23 and the drain pipe to obtain high efficiency of eliminating the effluent solids. When the wheel blade 40 rotates and cooperates with the cutter ring 50 during rotation cutting, the enhancing blocks 53 serving as the cutting portions 51 and the enhancing corners 44 at the outermost edge are resistant to damages by grit, small pebbles or solids contained in the effluent water to reduce wearing and abrasion because both pieces are made of high hardness material such as tungsten carbide. Not only keep the masserating efficiency during rotation cutting, the enhancing blocks 53 and enhancing corner 44 but also provide wearing resistance to extend the lifespan and increase utility of the blade set because the cutting portion and sharp edge are not damaged easily.

According to above illustration, the blade set performs the fundamental masserating function performed by the cutter ring 50 and the wheel blade 40 mounted at the effluent water inlet 22 of the lower base 20. Particularly, functioning portions such as distal edges of the blade strips on the wheel blade 40 and the cutting portion on the cutter ring 50 are replaced by the tungsten carbide pieces (i.e. the enhancing blocks 53 and the enhancing corners 44) so that durability of the blade set is significantly improved and the masserating efficiency is constantly kept excellent.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. A blade set for a sewage pump comprising:

a wheel blade adapted to be driven by a motor and having multiple blade strips formed on the wheel blade, wherein each of the multiple blade strip has an outermost edge, a cutout defined at the outermost edge, and an enhancing corner made of a wear-resisting rigid material and engaged with the cutout; and a cutter ring sleeving around the wheel blade and having an inner wall, multiple grooves and multiple recesses alternatively and longitudinally defined on the inner wall, wherein each of the multiple recess engages with an enhancing block made of a wear-resisting rigid material and slightly contacting with enhancing corners when the wheel blade rotates.

2. The blade set as claimed in claim 1, wherein the enhancing block and the enhancing corner are made of tungsten carbide.

* * * * *